US005298362A

United States Patent [19]

Beaumond et al.

[11] Patent Number: 5,298,362

[45] Date of Patent: Mar. 29, 1994

[54] PHOTOGRAPHIC HIGH-CONTRAST SILVER HALIDE MATERIALS

[75] Inventors: David Beaumond, Giles; Philip J. Coldrick, Hayes; Nicholas Pightling, Harrow, all of United Kingdom

[73] Assignee: Eastman Kodak Company, Rochester, N.Y.

[21] Appl. No.: 43,119

[22] Filed: Apr. 5, 1993

[30] Foreign Application Priority Data

Jun. 4, 1992 [GB] United Kingdom ..... 9211812

[51] Int. Cl.[5] ..... G03C 1/06

[52] U.S. Cl. ..... 430/264; 430/536; 430/537

[58] Field of Search ..... 430/264, 536, 537

[56] References Cited

U.S. PATENT DOCUMENTS

| | | | |
|---|---|---|---|
| 2,376,005 | 5/1945 | Potter et al. | 430/627 |
| 3,403,116 | 9/1968 | Ream et al. | 430/537 |
| 3,711,284 | 1/1973 | van Paesschen et al. | 430/537 |
| 4,245,036 | 1/1981 | De Winter et al. | 430/537 |
| 4,407,939 | 10/1983 | Naoi et al. | 430/537 |
| 4,424,273 | 1/1984 | Franco et al. | 430/537 |
| 4,906,560 | 3/1990 | Nittel et al. | 430/536 |
| 4,975,354 | 12/1990 | Machonkin et al. | 430/264 |
| 4,999,276 | 3/1991 | Kuwabara et al. | 430/264 |
| 5,019,494 | 5/1991 | Toya et al. | 430/537 |
| 5,098,818 | 3/1992 | Ito et al. | 430/434 |
| 5,104,769 | 4/1992 | Looker et al. | 430/264 |
| 5,213,944 | 5/1993 | Adin | 430/264 |
| 5,232,818 | 8/1993 | Machonkin et al. | 430/264 |
| 5,238,779 | 8/1993 | Adin et al. | 430/264 |

*Primary Examiner*—Charles L. Bowers, Jr.
*Assistant Examiner*—Thomas R. Neville
*Attorney, Agent, or Firm*—Alfred P. Lorenzo

[57] ABSTRACT

High contrast graphic arts photographic materials exhibiting improved accuracy in image reproduction are comprised of a support, a silver halide emulsion layer having a chloride content of at least 50 mole percent, and a non-electroconductive hydrophilic colloid layer containing both a vinyl polymer and a hydrophilic colloid interposed between the support and the silver halide emulsion layer. A hydrazine nucleating agent is incorporated in or adjacent to the silver halide emulsion layer and the photographic material preferably also contains an amino compound which functions as a booster.

11 Claims, 3 Drawing Sheets

PHOTOGRAPHIC HIGH-CONTRAST SILVER HALIDE MATERIALS

FIELD OF THE INVENTION

This invention relates in general to photography and in particular to novel black and white photographic elements. More specifically, this invention relates to high-contrast black-and-white photographic elements which are especially useful in the field of graphic arts and to methods of obtaining high contrast images therewith.

BACKGROUND OF THE INVENTION

For many years the very high contrast photographic images needed in the graphic arts and printing industries were obtained by developing a 'lith' emulsion (usually high in silver chloride content) in a hydroquinone, low sulfite, 'lith' developer by the process known as infectious development. However, such low sulfite developers are inherently unstable and are particularly inappropriate for machine processing.

Recently emulsions containing hydrazine nucleating agents have been used and processed in a developer with conventional amounts of sulfite, hydroquinone and possibly metal or a pyrazolidone. Such developers also essentially contain an amine additive as described in U.S. Pat. No. 4,269,929. Other developers containing amines are described in U.S. Pat. Nos. 4,668,605 and 4,740,452.

Many hydrazine nucleating agents have been proposed for use in such materials, for example in U.S. Pat. Nos. 4,323,643, 4,278,748, 4,031,127, 4,030,925, 4,323,643 and 5,104,769.

Copending commonly-assigned U.S. Pat. Application Ser. No. 941,083, filed Oct. 13, 1992, "Photographic High Contrast Silver Halide Materials" by Philip J. Coldrick and Julia Pich describes high contrast photographic silver halide materials, comprising a support bearing a layer of a silver halide emulsion comprising at least 50% silver chloride, sensitized with a dye of defined type which contain in or adjacent the emulsion layer a hydrazine nucleating agent and an amine booster, the combination of which is capable of providing high contrast images.

U.S. Pat. No. 4,999,276 describes photographic materials having a hydrophilic electrically-conductive layer between the support and the silver halide layer(s) which may contain a polymer.

U.S. Pat. No. 5,098,818 describes photographic materials which contain an antihalation hydrophilic colloid underlayer containing a solid particle dye dispersion which may contain polymer. Such materials are limited to those having a total coating weight of hydrophilic colloid on each side of the support of from 0.5 to 3 $g/m^2$.

During the last ten years, electronic dot-generating scanners for the production of film intermediates for the graphic arts printing process have increased their exposing capabilities, eg by means of sharper beam profiles. This increased accuracy of exposing means calls for an equivalent increase in the accuracy of reproduction obtainable from photographic materials.

It is an object of the present invention to provide such high contrast photographic materials of improved accuracy in image reproduction and, in particular, of scanner-generated dots.

SUMMARY OF THE INVENTION

According to the present invention there is provided a high contrast photographic material comprising a support bearing at least one silver halide emulsion layer, whose silver chloride content is at least 50 mole %, and having in or adjacent an emulsion layer a hydrazine nucleating agent; wherein the material has a non-electroconductive hydrophilic colloid layer containing a vinyl polymer, the weight ratio of the polymer:hydrophilic colloid being in the range 0.1 to 2.5 and the coating weight of the hydrophilic colloid layer being from 0.4 to 2.5 $g/m^2$ and wherein the hydrophilic colloid layer is located between the emulsion layer(s) and the support.

DESCRIPTION OF THE PREFERRED EMBODIMENTS

Figure 1:
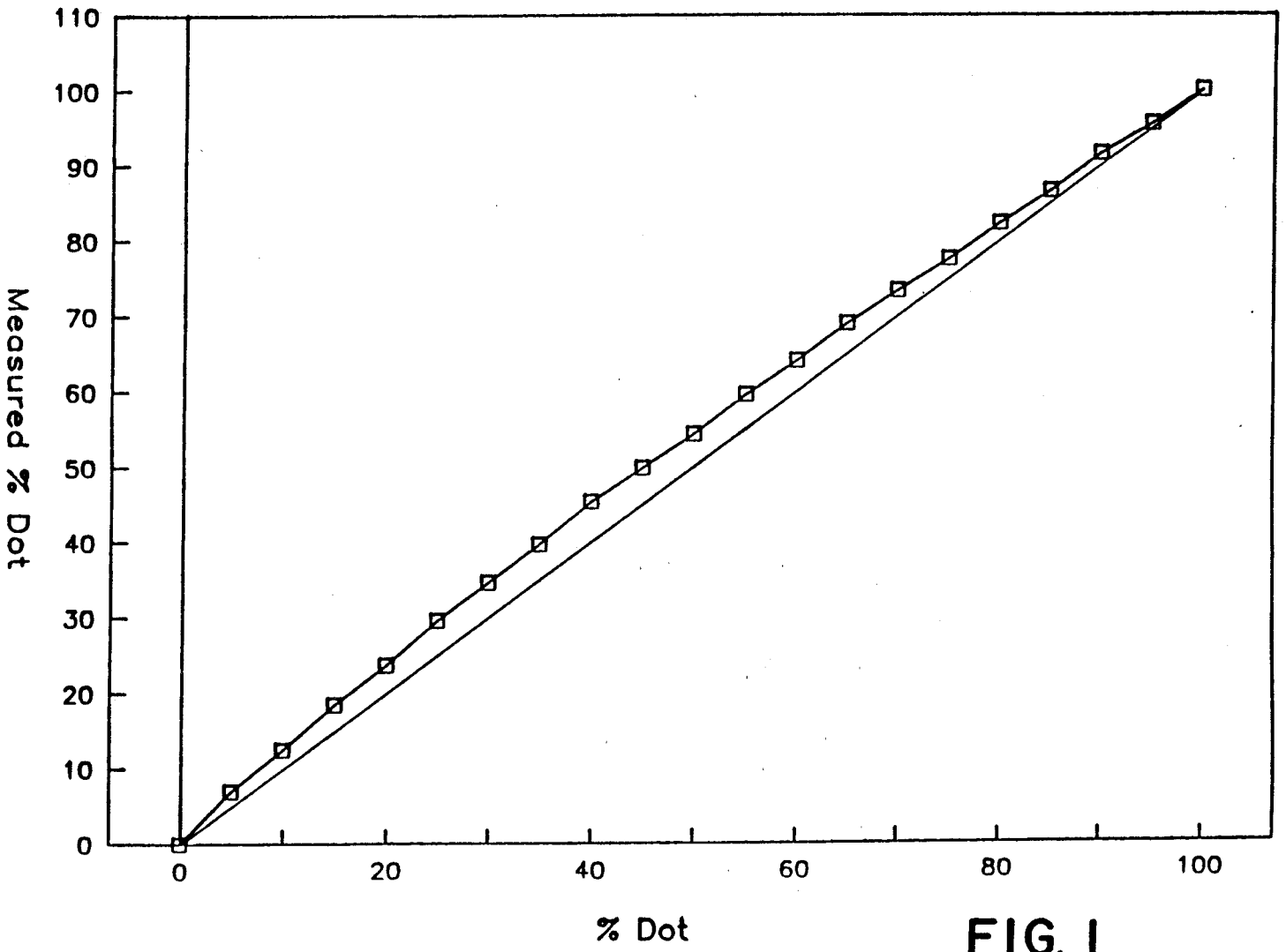
FIGS. 1, 2 and 3 are plots of % dot versus measured % dot illustrating the effect of including the non-electroconductive hydrophilic colloid layer in the high contrast photographic materials of this invention.

In the high contrast photographic materials of this invention, the hydrophilic colloid may be, for example, gelatin or a gelatin derivative, polyvinylpyrrolidone or casein. Suitable hydrophilic colloids and vinyl polymers are described in Section IX of Research Disclosure Item 308119,December 1989 published by Kenneth Mason Publications, Emsworth, Hants, United Kingdom. Gelatin is the preferred hydrophilic colloid.

The ratio of polymer:hydrophilic colloid is preferably in the range 0.2 to 2.0, more preferably 0.3 to 1.5, and especially 0.3 to 1.0.

The hydrophilic colloid/polymer layer preferably comprises a coating weight in the range of 0.4 to 2.0 $g/m^2$, preferably 0.4 to 1.8 $g/m^2$ and particularly 0.4 to 1.5 $g/m^2$.

The present photographic materials may also contain a supercoat hydrophilic colloid layer which may also contain a vinyl polymer located as the last layer of the coating (furthest from the support). It may contain some form of matting agent.

The vinyl polymer is preferably an acrylic polymer and preferably contains units derived from one or more alkyl or substituted alkyl acrylates or methacrylates, alkyl or substituted alkyl acrylamides, or acrylates or acrylamides containing a sulfonic acid group.

Any hydrazine compound that functions as a nucleator and is capable of providing a high contrast image can be used in the practice of this invention.

The hydrazine compound is incorporated in the photographic element, for example, it can be incorporated in a silver halide emulsion layer. Alternatively, the hydrazine compound can be present in a hydrophilic colloid layer of the photographic element, preferably a hydrophilic colloid layer which is coated to be adjacent to the emulsion layer in which the effects of the hydrazine compound are desired. It can, of course, be present in the photographic element distributed between or among emulsion and hydrophilic colloid layers, such as undercoating layers, interlayers and overcoating layers.

Such hydrazine compounds may have the formula:

$R^9$—NHNHCHO wherein $R^9$ is a phenyl nucleus having a Hammett sigma value-derived electron withdrawing characteristic of less than +0.30.

In the above formula, $R^9$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above.

The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentylphenoxy)-butyramido]phenyl)hydrazine,
1-Formyl-2-phenylhydrazine,
1 Formyl-2-(4-methoxylphenyl)hydrazine,
1-Formyl-2-(4-chlorophenyl)hydrazine,
1-Formyl-2-(4-fluorophenyl)hydrazine,
1-Formyl-2-(2 chlorophenyl)hydrazine, and
1-Formyl-2-(p-tolyl)hydrazine.

The hydrazine may also comprise an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea,
3-[4-(2-formylhydrazino)phenyl-5-(3-methyl-2-benzoxazolinylidene)rhodanine-6-([4-(2-formylhydrazino)phenyl]ureylene)-2-methylbenzothiazole,
N-(benzotriazol-5-yl) 4-(2-formylhydrazino) phenylacetamide, and
N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

An especially preferred class of hydrazine compounds for use in the elements of this invention are sulfonamido-substituted hydrazines having one of the following structural formulae:

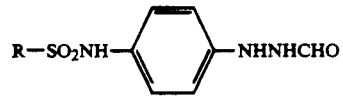

or

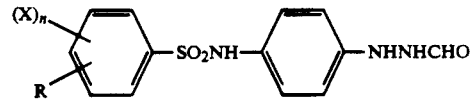

wherein:

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2R_2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to 4 carbon atoms, halogen atoms (e.g. chlorine and fluorine), or $—NHCOR^2$—or $—NHSO_2R^2$—where $R^2$ is as defined above. Preferred R alkyl groups contain from 8 to 16 carbon atoms since alkyl groups of this size impart a greater degree of insolubility to the hydrazine nucleating agents and thereby reduce the tendency of these agents to be leached during development from the layers in which they are coated into developer solutions.

Heterocyclic groups represented by R include thienyl and furyl, which groups can be substituted with alkyl having from 1 to 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to 4 carbon atoms, halogen atoms (e.g. chlorine or fluorine); or $—NHCOR^2$ or $—NHSO_2R^2$ where $R^2$ is as defined above. Preferred alkyl or alkoxy groups contain from 1 to 5 carbon atoms in order to impart sufficient insolubility to the hydrazine nucleating agents to reduce their tendency to being leached out of the layers in which they are coated by developer solution.

Alkyl, thioalkyl and alkoxy groups which are represented by X contain from 1 to 5 carbon atoms and can be straight or branched chain. When X is halogen, it may be chlorine, fluorine, bromine or iodine. Where more than one X is present, such substituents can be the same or different.

Particularly preferred nucleators have the following formulae:

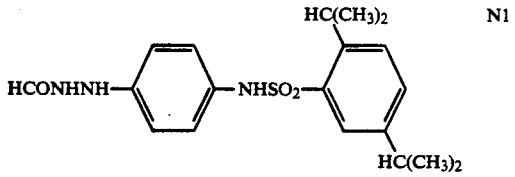

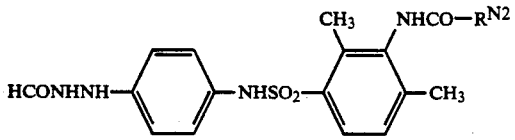

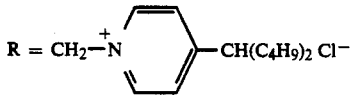

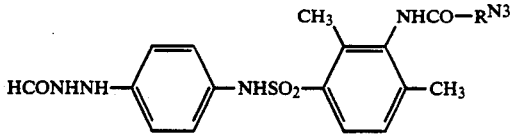

$R = -CH_2S-(CH_2CH_2O)_4-C_8H_{17}$

The present materials may also contain an amine booster. The preferred amine boosters to be used in the present invention are those described in U.S. Pat. No. 4,975,354 wherein they are defined as an amino compound which:

(1) comprises at least one secondary or tertiary amino group, (2) contains within its structure a group comprised of at least three repeating ethyleneoxy units, and (3) has an n-octanol/water partition coefficient (log P) of at least one, preferably at least three, and most preferably at least four, log P being defined by the formula:

$$\log P = \log \frac{|(X)|_{octanol}}{|(X)|_{water}}$$

wherein X is the concentration of the amino compound.

Included within the scope of the amino compounds utilized in this invention are monoamines, diamines and polyamines. The amines can be aliphatic amines or they can include aromatic of heterocyclic moieties. Aliphatic, aromatic and heterocyclic groups present in the amines can be substituted or unsubstituted groups. Preferably, the amino compounds employed in this invention as "incorporated boosters" are compounds of at least 20 carbon atoms. It is also preferred that the ethyleneoxy units are directly attached to the nitrogen atom of a tertiary amino group.

Preferably the partition coefficient is at least three, most preferably at least four.

Preferred amino compounds for the purposes of this invention are bis-tertiary-amines which have a partition coefficient of at least three and a structure represented by the formula:

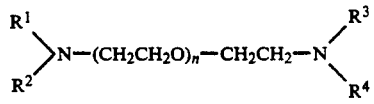

wherein n is an integer with a value of 3 to 50, and more preferably 10 to 50, $R_1$, $R_2$, $R_3$ and $R^4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another preferred group of amino compounds are bis-secondary amines which have a partition coefficient of at least three and a structure represented by the formula:

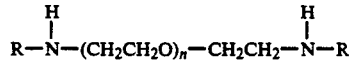

wherein n is an integer with a value of 3 to 50, and more preferably 10 to 50, and each R is, independently, a linear or branched, substituted or unsubstituted, alkyl group of at least 4 carbon atoms.

The present photographic materials preferably contain an antihalation layer on either side of the support. Preferably it is located between the emulsion layer(s) and the support. In a preferred embodiment an antihalation dye is contained in the hydrophilic colloid underlayer. The dye may be dissolved in the underlayer or, preferably, be present in the form of a dispersion of solid particles. Suitable dyes are listed in the aforesaid U.S. Pat. Application Ser. No. 941,083, filed Oct. 13, 1992.

The photosensitive silver halide emulsions employed in the present materials may contain both silver bromide and silver iodide in addition to the silver chloride. Preferably the iodide content is less than 10 mole percent. Substantially pure silver chloride emulsions may be used although the preferred emulsions comprise 70 mole % chloride and 30 mole % bromide. As is known in the graphic arts field, the grains may be doped with rhodium, ruthenium, iridium or other Group VIII metals, either alone or in combination. The emulsions may be negative or direct positive emulsions, mono- or polydisperse.

Preferably the silver halide grains are doped with a Group VIII metal at levels in the range $10^{-9}$ to $10^{-3}$, most preferably $10^{-6}$ to $10^{-3}$,mole metal per mole of silver. The preferred Group VIII metals are rhodium and/or iridium.

The emulsions employed and the addenda added thereto, the binders, supports, etc may be as described in Research Disclosure Item 308119, December 1989 published by Kenneth Mason Publications, Emsworth, Hants, United Kingdom.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent.

Very high contrast images can be obtained at pH values in the range of from 11 to 12.3, but preferably lower pH values, for example below 11 and most preferably in the range of 10.3 to 10.5 are employed for processing the photographic recording materials as described herein.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Chelating and sequestering agents, such as ethylene-diaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The following example is included for a better understanding of the invention.

Coatings on polyethylene terephthalate subbed film base were made as follows:

Coatings 1, 2, 3 and 4 are three layer coatings consisting of a gel underlayer, an emulsion layer and a supercoat. The underlayer is coated to provide 1 g/m$^2$ of gelatin and 0.3, 1.0, 1.5 and 2.0 g/m$^2$ respectively of latex copolymer (A), methyl acrylate:2-acrylamido-2-methylpropane sulfonic acid (in the weight ratio 58:1).

The emulsion layer consists of a 70:30 chlorobromide cubic monodispersed emulsion (0.18 μm edge length) uniformly doped with ammonium hexachlororhodate at 0.17 mg/Ag mole and coated at 3.4 g Ag/m$^2$ in a gel vehicle of 2.5 g/m$^2$. The emulsion is chemically sensitized with sulfur and gold. Other addenda included in the layer are sensitizing dye A at 390 mg/Ag mole, hydroquinone at 5.3 g/Ag mole, 2-methylmercapto-5-carboxy-6-methyl tetraazaindene at 243 mg/Ag mole, latex copolymer (B) methyl acrylate, 2- acrylamido-2-methylpropanesulfonic acid and the sodium salt of 2-acetoxyethyl methacrylate (88:5:7 by weight) at 22 g/Ag mole, sequestering agent (EDTA di-Na salt) at 1.8 g/Ag mole, nucleating agent N3 at 180 mg/m$^2$ and incorporated booster C at 2.0 g/Ag mole.

The supercoat consists of gel at 0.5 g/m$^2$ with surfactant to aid coating and matting beads to aid film handling. The layers are hardened with BVSM at 3% of the total gel.

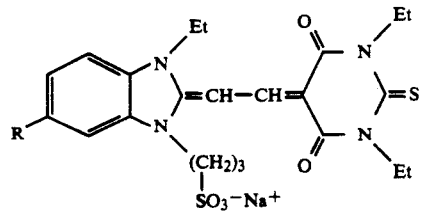

Nucleating agent N3 is:

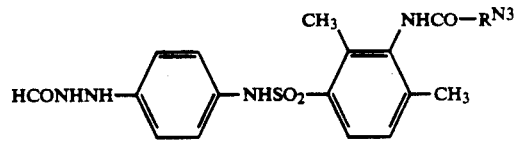

R = $-CH_2S-(CH_2CH_2O)_4-C_8H_{17}$ and Booster C is:

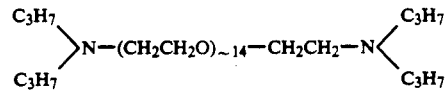

Coating 5: as Coating 3 but using copolymer (B) in the underlayer.

Coating 6: (comparative) as Coating 1 but with no underlayer.

Coating 7: (comparative) as Coating 6 but with a gel interlayer at 1 g/m$^2$ between the emulsion and supercoat layers.

For photographic evaluation, the coating was exposed by a HELL DC380 Argon-ion scanner and a test pattern was exposed to give the ranges of dot sizes for assessment. The material was then processed in the following developer solution:

| | g/liter |
|---|---|
| Potassium hydroxide (45%) | 44.5 |
| Sodium metabisulfite | 36.3 |
| Potassium bromide | 3.0 |
| Sodium hydroxide (50%) | 14.0 |
| Benzotriazole | 0.1 |
| Phenylmercaptotetrazole | 0.013 |
| Hydroquinone | 18.75 |
| 4-Methyl-4-hydroxymethyl-1-phenyl-3-pyrazolidone | 0.725 |
| Potassium carbonate 47% | 30.0 |
| Diethylene glycol | 27.5 |
| Boric acid | 1.73 |
| pH = | 10.35 |

A processing temperature of 35° C. and development time of 30s was used.

The dot sizes were measured on a Graphic Arts X-Rite densitometer. The results are set out in the table below in which:

LOF (light on film) is a measure of the exposure given,

Dmax is maximum density at the quoted LOF,

Dmin is the minimum density, the dot % figures are the nominal dot sizes exposed, gamma is the contrast between the 0.1 and 2.5 density points.

| Coating | LOF | Dmax | Dmin | 5% dot % | 50% dot % | 95% dot % | gamma |
|---|---|---|---|---|---|---|---|
| 1 | 80 | 4.67 | 0.018 | 7 | 53 | 95 | 15.61 |
| 2 | 80 | 4.30 | 0.018 | 7 | 53 | 95 | 15.07 |
| 3 | 80 | 5.02 | 0.023 | 6 | 52 | 95 | 17.08 |
| 4 | 100 | 4.46 | 0.016 | 5 | 50 | 95 | 10.98 |
| 5 | 80 | 4.94 | 0.022 | 6 | 52 | 95 | 16.33 |
| 6(comp.) | 70 | 4.71 | 0.020 | 7 | 55 | 96 | 17.98 |
| 7(comp.) | 110 | 4.15 | 0.020 | 7 | 54 | 96 | 8.48 |

The results show that the coatings which most closely match the exposed dot sizes, have the highest Dmax, lowest Dmin and have good gamma are (3) (4) and (5) all of which contain the polymer:gelatin underlayer. The position of the extra layer is important because the interlayer of coating (7) did not give the same good results. With no extra layer at all (6) the reproduction of the dot sizes was worse.

Figure 2:
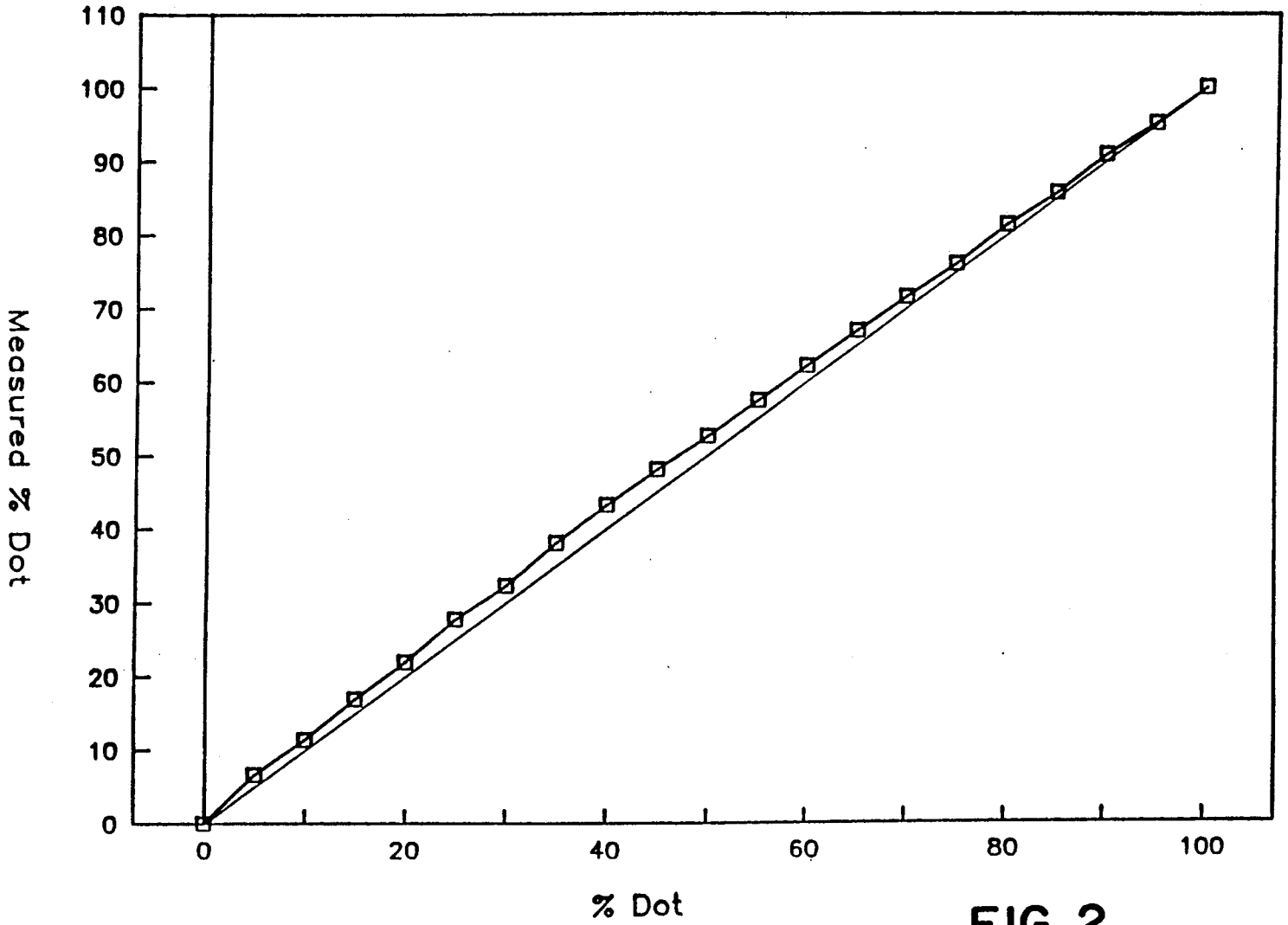
Figure 3:
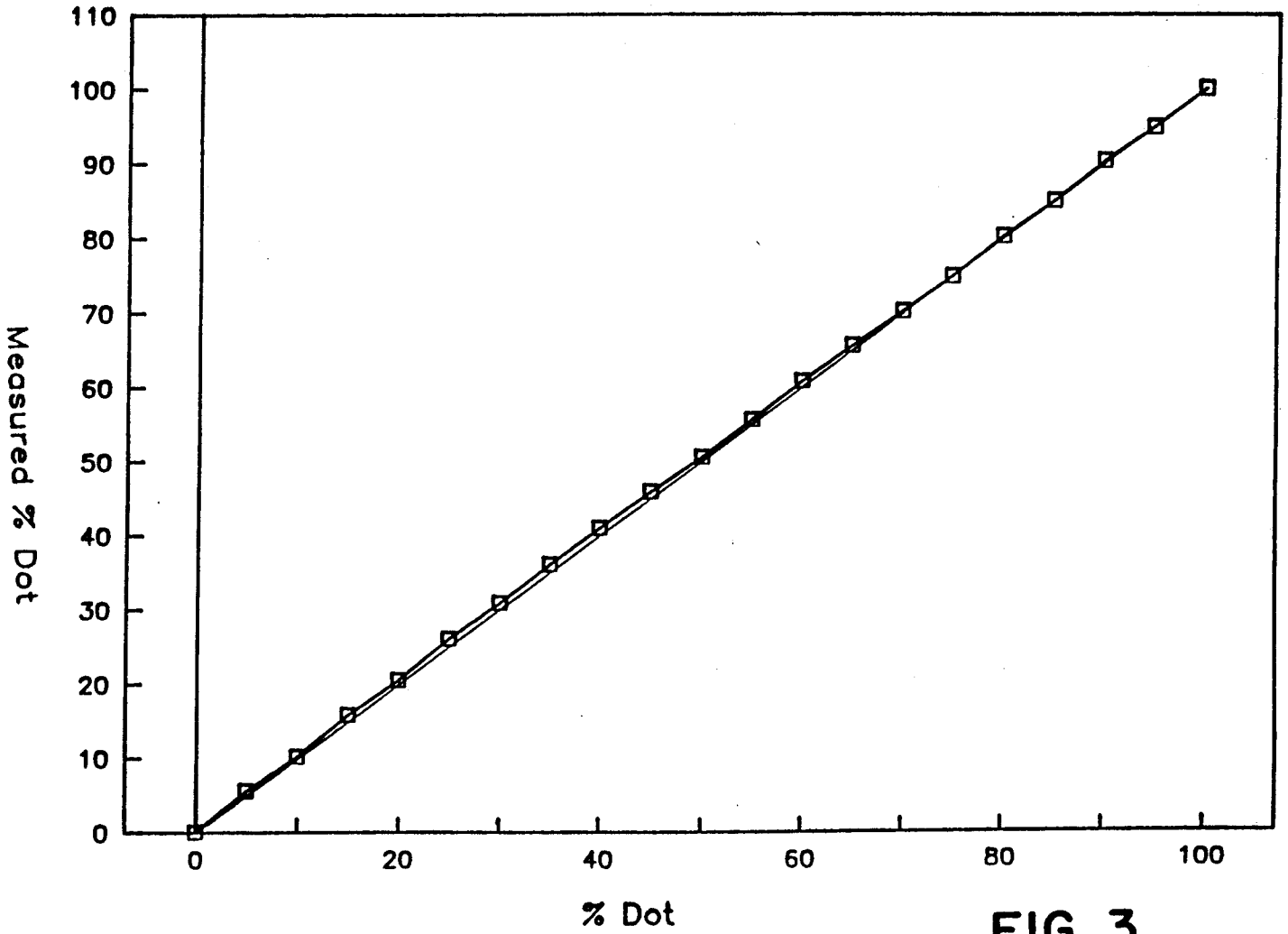

FIGS. 1, 2 and 3 of the accompanying drawings illustrate the results from Coatings 6 (comparison), 1 and 4 respectively. It can be seen that measured dot sizes (plotted as □) progressively approach the theoretical value shown as a straight line in FIGS. 2 and 3 respectively.

The invention has been described in detail, with particular reference to certain preferred embodiments thereof, but it should be understood that variations and modifications can be effected within the spirit and scope of the invention.

We claim:

1. A high contrast photographic material comprising a support, a silver halide emulsion layer having a chloride content of at least 50 mole percent, and a non-electroconductive hydrophilic colloid layer interposed between said support and said silver halide emulsion layer which serves to provide improved accuracy in image reproduction, said photographic material having both a hydrazine nucleating agent and an amino compound that functions as a booster in or adjacent to said silver halide emulsion layer, said non-electroconductive hydrophilic colloid layer containing a vinyl polymer and a hydrophilic colloid in a weight ratio of polymer to colloid in the range of 0.1 to 2.5 and having a coating weight of from 0.4 to 2.5 g/m$^2$.

2. A high-contrast photographic material as claimed in claim 1 wherein said vinyl polymer is an acrylic polymer.

3. A high-contrast photographic material as claimed in claim 1 wherein said vinyl polymer contains units derived from one or more alkyl or substituted alkyl acrylates or methacrylates, alkyl or substituted alkyl acrylamides, or acrylates or acrylamides containing a sulfonic acid group.

4. A high-contrast photographic material as claimed in claim 1 wherein said hydrophilic colloid is gelatin.

5. A high contrast photographic material as claimed in claim 1 wherein the weight ratio of polymer to colloid is in the range of 0.2 to 2.0.

6. A high-contrast photographic material as claimed in claim 1 wherein the weight ratio of polymer to colloid is in the range of 0.3 to 1.5.

7. A high-contrast photographic material as claimed in claim 1 wherein said coating weight is from 0.4 to 2.0 g/m$^2$.

8. A high contrast photographic material as claimed in claim 1 wherein said coating weight is from 0.4 to 1.5 g/m$^2$.

9. A high-contrast photographic material as claimed in claim 1 wherein said material additionally comprises a supercoat hydrophilic colloid layer.

10. A high-contrast photographic material as claimed in claim 1, wherein said hydrazine nucleating agent has one of the following structural formulae:

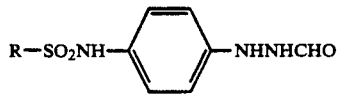

or

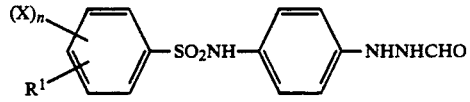

wherein:

$R^1$ is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —NHCOR$^2$, —NHSO$_2$R$^2$, —CONR$^2$R$^3$ or —SO$_2$R$^2$R$^3$ where R$^2$ and R$^3$, which can be the same or different, are hydrogen or alkyl having from 1 to about 4 carbon atoms; and n is 0, 1 or 2.

11. A high-contrast photographic material as claimed in claim 1 wherein said amino compound:

(1) comprises at least one secondary or tertiary amino group, (b 2) contains within its structure a group comprised of at least three repeating ethylenoxy units, and (3) has an n-octanol/water partition coefficient (log P) of at least one;

log P being defined by the formula:

$$\log P = \log \frac{|(X)|_{octanol}}{|(X)|_{water}}$$

wherein X is the concentration of the amino compound.

* * * * *